United States Patent [19]

Ryan et al.

[11] 4,121,987

[45] Oct. 24, 1978

[54] ELECTROPHORETIC SLIP CASTING

[75] Inventors: William Ryan; Ebrahim Massoud, both of Stoke-on-Trent, England

[73] Assignee: National Research Development Corporation, London, England

[21] Appl. No.: 843,735

[22] Filed: Oct. 19, 1977

[51] Int. Cl.[2] ..... C25D 1/14; C25D 1/20

[52] U.S. Cl. ..... 204/181 F

[58] Field of Search ..... 204/181 N

[56] References Cited

U.S. PATENT DOCUMENTS

| | | | |
|---|---|---|---|
| 1,337,811 | 4/1920 | Allen | 204/181 F |
| 3,718,564 | 2/1973 | Ebrey | 204/181 F |

*Primary Examiner*—Howard S. Williams

*Attorney, Agent, or Firm*—Cushman, Darby & Cushman

[57] ABSTRACT

An electrically-conductive porous carbonaceous mould is made, as regards the carbonaceous component, from particles of maximum diameter 70 to 200 microns, and is then especially suitable for use in electrophoretically assisted slip casting.

5 Claims, 2 Drawing Figures

ELECTROPHORETIC SLIP CASTING

BACKGROUND OF THE INVENTION

This invention relates to electrophoretic slip casting of ceramic articles.

Slip casting is commonly used to form hollow ceramic articles. In this process, an aqueous suspension (known as "slip") of a ceramic material (which phrase includes a mixture of ceramic materials), for example clay, is poured into a Plaster of Paris mould of the required shape. The mould, being porous, removes water from the slip by capillary action, and a cast of the clay or other material gradually builds up on the mould surface. When this cast is of the desired thickness, excess slip is poured out of the mould, and the cast is allowed partially to dry in the mould. During drying the cast shrinks away from the plaster mould allowing the cast to be removed, further dried and then fired, to form the finished ceramic article.

This casting process is rather slow. Also, the rheological properties of the slip are critical, with minor variations in viscosity and thixotropy resulting in casting faults.

It has been proposed to assist the casting process by means of electrophoresis. Application of a direct current potential difference between two electrodes suitably placed, one in contact with the mould and the other in the slip contained in the mould, causes a migration of the solid particles suspended in the slip to the walls of the mould to form the cast. Unfortunately, however, this potential difference simultaneously electrolyses the water of the slip, and gas evolved at the electrode in contact with the mould spoils the surface of the cast. Nonetheless, electrophoretic slip casting is still desirable as it can speed up casting by a factor of 10 or more and does not require such close control of the rheological properties of the slip. Also, by replacing Plaster of Paris moulds by stronger, conductive moulds, it allows mould life to be extended well beyond the 70 or so fillings which is typical of the life of a plaster mould used for conventional slip casting.

BRIEF DESCRIPTION OF THE INVENTION

According to the present invention, a method of slip casting an article comprises placing an aqueous suspension of a ceramic material in a fired or cured mould having an electrically conductive porous carbonaceous operative surface conforming to the desired surface of the article, the carbonaceous component of the surface region being (before firing or curing of the mould) particles of from 70μm to 200μm maximum diameter, electrically charging the operative surface of the mould in the opposite sense to the charge carried by the material in the suspension, removing the remaining suspension after the material has built up to a desired thickness in the mould, and removing the material in the form of the desired article from the mould.

The method usually comprises subsequent drying and firing of the article, to give it strength.

DETAILED DESCRIPTION OF THE INVENTION

Figure 1:
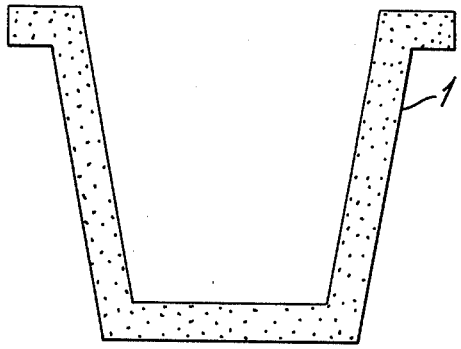
FIGS. 1 and 2 are sectional views of typical moulds used in the present invention.

The operative surface of the mould is preferably generally concave, the corresponding desired surface of the article being generally convex and the article usually being hollow, although flat shapes, and solid articles having convex surfaces, can be made.

The charge on the operative surface of the mould usually renders it anodic with respect to the suspension, but as suspensions of alumina ($A1_2O_3$) and some other oxide ceramics are positively charged in acid suspension (in which they are usually slip cast), the charge on the operative surface of the mould would in these cases have to be negative.

The mould may be made by isostatic pressing, slip casting (preferably according to the invention) or plastic shaping, from a mixture including a carbonaceous component whose maximum particle diameters are from 70μm to 200μm, preferably 70μm to 150μm if the mould is made by casting, and preferably from 100μm to 200μm if by pressing. The mould is then usually fired, preferably at from 900° to 1100° C.

As regards the pore size of the operative surface of the resulting fired or cured mould, this is believed to be rather uniform, at from 2μm to 4μm. If the pores are of non-uniform size, the largest (apart from a negligible proportion) are believed to be of a diameter from 2μm to 4μm — that is, substantially none of the pores in the operative surface of the mould has a diameter exceeding 4μm, while a significant number of pores is at least 2μm in diameter.

The mould's operative surface region, which as already said has a carbonaceous component of maximum particle diameter 70 to 200μm, is preferably of matter containing at least 50% by weight of carbon. The matter may contain at least 30%, advantageously at least 50%, desirably at least 60%, of graphite. It is possible for some of the carbon to be present in the form of graphite and some in the form of amorphous carbon. The matter can contain, apart from carbon, one or more of ball clay, cement, aluminium phosphate, and sand and cement which is/are preferably present in the form of particles substantially all smaller than 15μm (advantageously, smaller than 10μm) in diameter. In this way, it is believed that the advantageous pore sizes set forth above can be achieved.

The invention also provides a double slip casting method, wherein two moulds constructed as set forth above are held so as to define between their operative surfaces, which are electrically insulated from each other, the desired shape of a solid article; an aqueous suspension of a ceramic material is placed to occupy the space between the operative surfaces; the surfaces are electrically charged in opposite senses; before the material has built up to the thickness of the shape, the electrical charges are reversed and held until the material has built up to that thickness; and the resulting solid article of the desired shape is removed, the operative surfaces being moved apart if necessary. Drying and firing preferably ensue.

The solid article is preferably of generally uniform thickness and preferably of dished shape. One operative surface then preferably defines the convex surface and the other the concave, the electrical charge on the former being firstly the opposite to the charge carried by the material in suspension and, after the reversal, the same.

The invention further provides a fired or cured mould in which a hollow article may be made by slip casting, the mould having an operative surface conforming to the desired surface of the article, the operative surface being electrically conductive, of carbonaceous matter and porous, the carbonaceous component of the operative surface region being (before firing or curing of the mould) particles of from 70μm to 200μm maximum diameter, preferably resulting in that the largest pores are of a diameter from 2μm to 4μm. The operative surface may define, for example, a basin, a bath, a lavatory pedestal or a lavatory cistern. In matters of detail, the mould may be as set forth above.

There may be an assembly, comprising a pair of moulds for use in the double slip casting method as set forth above.

A machine may hold several moulds or assemblies as set forth above, with means for pouring aqueous suspension into them, means for applying (and, if necessary, reversing) a voltage between the operative surface and the suspension and means for pouring excess suspension out of the moulds. There may be means for removing articles from the moulds and for forwarding them to drying equipment.

The invention extends to an article made by the method, in the mould or using the machine as set forth above, which article may be dried and fired.

As will be appreciated, the operative surface of the mould, being carbonaceous, is conductive and, when rendered (usually) anodic with respect to the suspension, itself acts as an electrode which by reason of its porous nature is permeable to bubbles of gas formed there during electrophoresis. The pores either retain the gas or provide an escape path for it in preference to evolution at the mould surface, in addition to abstracting water from the slip.

If the pores are too large, a cast will form satisfactorily but the mould will not remove water strongly enough during drying in the mould, before the cast is removed from the mould. Hence, the cast will not shrink away from the mould, and even if it can be removed from the mould, it may well crack on drying or firing, because the cast has a high moisture content and an uneven moisture distribution.

If on the other hand the pores are too small, casting and shrinking away from the mould will be satisfactory but evolved gas will spoil the surface of the cast.

Although the cast may be partly blackened in a graphite-only mould, this is of no consequence since on firing the blackening (being carbon) will simply oxidise away. Little or no carbon is picked up, in any case, from harder carbonaceous moulds.

Preferably the entire mould is constructed of porous carbonaceous matter, but it is also possible to construct the mould with an operative surface which is a porous carbonaceous layer acting as an electrode, this layer being backed by some suitable support, for example of plastics, which can withstand drying temperatures of up to 100° C. An entirely carbonaceous mould is preferably dired out at 100° C or more. This makes for much faster drying out between successive casting operations than is possible with Plaster of Paris moulds. It is not desirable for metal to be a constituent of the carbonaceous layer, as it may be attacked electrolytically and may contaminate the article being made.

Examples of carbonaceous matter which may constitute the operative surface are as follows. Percentages are by weight and sizes are maximum particle sizes. For the carbonaceous component, 70μm is the minimum particle size.

Graphite (crystalline) (60%, 100μm) + ball clay (40%), isostatically pressed or slip cast or electrophoretically cast or plastically shaped to give desired pore size.

Graphite (60%, 200μm) + sanitary-ware body (40%).

Graphite (70%, 200μm) + cement (30%, 10μm)

Graphite (60%, 200μm) + cement (10–20%) + sand (balance, 10μm)

Graphite (80–90%, 150μm) + aluminium phosphate (10–20%, 10μm)

Graphite (60–70%, 150μm) + plastics thermosetting at 170–200° C (20–30%, 10μm)

Graphite (60–70%, 150μm) + coal tar pitch (20–30%.)

Graphite (30%) + amorphous (non-crystalline) carbon (30%) + cement (10μm) or ball clay (40%).

Graphite (50%, 200μm) + silicon carbide (10–20%, 100μm) + cement (10μm) or ball clay (30–40%)

Graphite (30% + coal (20%) + silicon carbide (20%) + cement (10μm) or ball clay (30%).

It is also possible, where stronger moulds are required, for the non-carbonaceous part of the matter to be carborundum or other ceramic and, indeed, the mould may itself be made by slip casting, preferably according to the invention. Otherwise, it may for example be made by ramming the components until the desired pore size is reached. A mixture of carbon graphite and silicon carbide can give the mould good strength and abrasion resistance. Where the non-carbonaceous part of the matter is cement, aluminium phosphate or thermosetting plastics, the mould needs no firing but only a low curing temperature, for example from room temperature to 200° C. Moulds of these materials are reasonably strong compared with Plaster of Paris.

The aqueous suspension of material may be of pottery ware, refractories or other materials used as pure substances or mixtures thereof, which, when fired, form a ceramic article. Such suspensions are generally known informally as "slip." Most ceramic particles are negatively charged in suspension so that the mould electrode will usually be the positive electrode (anode) in the system. Some ceramic suspensions such as alumina may be positively charged, depending on conditions, in which case the mould electrode will be the negative electrode.

The thickness of the casting is determined by suspension concentration, applied potential gradient and deposition time and these can be quite easily controlled.

Removal of gas evolved at the mould surface can be assisted by applying suction to the porous layer. Similarly, release of the cast from the mould can be hastened by application of compressed air to the porous layer of the mould.

A cathode is normally present immersed in the suspension, and must be designed with care, as slight irregularities will lead to local variations in current density and hence to a spoiled article. The cathode may be of wire netting formed into a reduced-scale approximation of the desired interior shape of the hollow article and placed centrally in such shape, to impart negative charge (with respect to the operative surface of the mould) to the suspension. Alternatively, the cathode may be of porous carbonaceous matter, conveniently the same as the mould operative surface. In such a case it is advantageous to apply suction from inside the cathode, to remove gas bubbles which might form and which might affect the current density in places.

In the double slip casting method set forth above, this problem does not arise since a solid cast is formed between the two operative mould surfaces, and both inner (concave) and outer (convex) surfaces are of good quality.

The slip composition and concentration, although not too critical, should be monitored, preferably continuously. Deposition rates, when using the method according to the invention, are approximately linearly proportional to time and are a function of the slip concentration. It is possible to make an article having a wall thickness of 1 cm which has been built up in as little as 4 minutes.

To maintain the consistency of the slip, it is desirable to include therein a deflocculant, for example 0.02 wt % of sodium silicate. Otherwise, flocculation of the slip may not only prevent a sound hollow article from being slip-cast, but may cause flocks to form on the cathode especially if it is of porous carbonaceous matter, whereby the flocks might damage the interior of the hollow article as the cathode is withdrawn, prior to removal (e.g. decantation) of excess slip. This particular problem does not, of course, arise in the case of double slip casting.

In operation, an anode/cathode potential difference of 50 to 80 volts may be applied, and smaller or larger voltages may be appropriate in the case of smaller and larger hollow articles respectively. In an article a few inches in size, 60V is an effective voltage, and not so large as to cause an unwanted degree of heating. A total current flow of ½ amp to 5 amps may be expected for a moderately small article, with a current density at the mould surface of the order of 60 to 180 milliamps per square centimeter.

Figure 2:
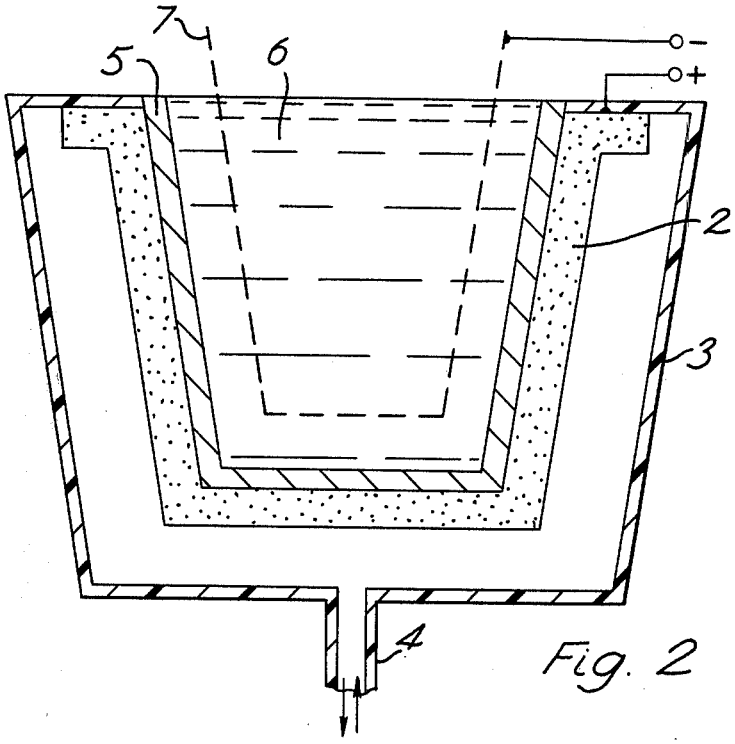

The invention will now be illustrated by way of example with reference to the accompanying drawings in which FIGS. 1 and 2 are diagrammatic illustrations of typical moulds for use in the invention.

EXAMPLE

An earthenware crucible 12 cm in height and with diameters 7cm (top) and 4 cm (bottom) and of wall thickness 5 mm is cast from an earthenware body slip having a solids conecentration of 37 ozs. per pint plus 0.02 weight percent of sodium silicate as a deflocculant. The crucible is cast in a porous mould composition 60% graphite and 40% clay and having a 0 to 3 micron pore size distribution and wall thickness 4mm. Electrophoresis is carried out between a zinc gauze electrode which is the negative electrode (cathode) immersed in the slip, and the porous carbon mould which is the positive electrode (anode), the potential gradient being 25 volts per centimeter and the gap between the two electrodes 1.5 cm, the voltage thus being about 40 volts, which gave a current of about 1.4 amps. After deposition to the thickness of 5mm, which takes about 2 minutes, excess slip is poured out and the cast is allowed partially to dry. During drying, it spontaneously shrinks and thus is easily removed from the mould, whereupon it is further dried before being fired by conventional means. Meanwhile, the mould is dried, for its next use, by heating to 100° C or more. Typical moulds are illustrated diagrammatically in the accompanying drawings.

FIG. 1 represents a mould of porous carbon. FIG. 2 shows a porous carbon mould 2 supported in an outer section 3 of plastics material which is formed as a vacuum chamber having a connection 4 for application of vacuum or positive pressure. The cast deposit 5, and the slip 6 in contact with a negative electrode 7 are shown inside the mould. The centrally positioned negative electrode 7 is a reduced-scale approximation of the desired interior shape of the hollow article being made.

Vacuum may be applied between the mould and the outer plastic casing to remove gas generated at the mould electrode during deposition. In addition after pouring off the excess slip and partial drying of the cast, compressed air may be applied between the mould and the outer casing, aiding the rapid removal of the cast from the mould.

We claim:

1. In a method of slip casting an article, comprising placing an aqueous suspension of a ceramic material in a mould having an electrically conductive porous carbonaceous opeative surface conforming to the desired surface of the article, electrically charging the operative surface of the mould in the opposite sense to the charge carried by the material in the opposite sense to the charge carried by the material in the suspension, removing the reamining suspension after the material has built up to a desired thickness in the mould and removing the material in the form of the desired article from the mould, the improvement consisting in that the carbonaceous component of the surface region of the mould, before firing or curing of the mould, is particles of maximum diameter from 70μm to 200μm.

2. The method of claim 1, wherein the mould itself is made by the slip casting method of claim 1.

3. The method of claim 2, wherein the mould is fired at from 900°to 1100° C.

4. The method of claim 2, wherein te operative surface region of the mould contains at least 50% by weight of carbon.

5. In a double slip casting method, wherein two moulds are held so as to define between their opertive surfaces, which are electrically insulated from each other, the desired shape of a solid article; an aqeouous suspension of a ceramic material is placed to occupy the space between the opetive surfaces; the surfaces are electrically charged ifn opposite senses; before the material has built up to the thickness of the shpae, th electrical charges are reversed and held until the material has built up to that thickness; and the resulting solid article of the desired shape is removed, the opeative surfaces being moved apart if necessry, the improvment consisting in that the operative surface of each of the moulds is electrically conductive, porous and the operative surface region of each comprises a carbonaceous component of a maximum particle diameter, before firing or curing of the mould, of 70μm to 200μm.

* * * * *

UNITED STATES PATENT AND TRADEMARK OFFICE

CERTIFICATE OF CORRECTION

PATENT NO. : 4,121,987

DATED : October 24, 1978

INVENTOR(S) : William RYAN and Ebrahim MASSOUD

It is certified that error appears in the above-identified patent and that said Letters Patent are hereby corrected as shown below:

In the heading:

Please add to Item [30] the following omitted Foreign Application Priority Data:

October 22, 1976 United Kingdom....43978/76

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*